US007594712B2

(12) United States Patent
Hasegawa

(10) Patent No.: US 7,594,712 B2
(45) Date of Patent: Sep. 29, 2009

(54) INK-JET PRINTER

(75) Inventor: Shin Hasegawa, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 430 days.

(21) Appl. No.: 11/271,603

(22) Filed: Nov. 10, 2005

(65) Prior Publication Data

US 2006/0109331 A1 May 25, 2006

(30) Foreign Application Priority Data

Nov. 19, 2004 (JP) ..... 2004-336091

(51) Int. Cl.
*B41J 29/13* (2006.01)
*B41J 2/165* (2006.01)
*B41J 2/215* (2006.01)
*B41J 23/00* (2006.01)

(52) U.S. Cl. ..... 347/37; 347/34; 347/83; 347/108

(58) Field of Classification Search ..... 347/108, 347/34, 83, 400, 86, 37, 38, 39, 22, 25
See application file for complete search history.

(56) References Cited

U.S. PATENT DOCUMENTS 6,561,620 B2 5/2003 Pietrzyk et al.
6,634,738 B1 * 10/2003 Shinada et al. ..... 347/86

FOREIGN PATENT DOCUMENTS

JP 2002361858 12/2002

* cited by examiner

*Primary Examiner*—Julian D Huffman
*Assistant Examiner*—Kar Yip
(74) *Attorney, Agent, or Firm*—Reed Smith LLP

(57) ABSTRACT

An ink-jet printer, including: a casing; a head unit which is disposed in the casing and which includes (a) a carriage that moves reciprocally relative to a recording medium and (b) a recording head mounted on the carriage for ejecting ink droplets from a plurality of nozzle holes; and a pair of skirt members which are provided respectively on opposite sides of the carriage as seen in a carriage-moving direction in which the carriage moves, so as to protrude outwardly from respective first side surfaces of the carriage that are opposed to each other in the carriage-moving direction and which are flush with a nozzle surface of the recording head in which the plurality of nozzles are open, for rectifying air flows which are generated as a result of the movement of the carriage and which flow on the recording medium, each of the pair of skirt members protruding, in the carriage-moving direction, at opposite end portions thereof as seen in a perpendicular direction that is perpendicular to the carriage-moving direction in plan view, by an amount larger than at a middle portion thereof as seen in the perpendicular direction.

10 Claims, 6 Drawing Sheets

PRIOR ART

INK-JET PRINTER

The present application is based on Japanese Patent Application No. 2004-336091 filed on Nov. 19, 2004, the contents of which are incorporated herein by reference.

BACKGROUND OF THE INVENTION

1. Field of the Invention

The present invention relates in general to an ink-jet printer.

2. Discussion of Related Art

Generally, in an ink-jet printer wherein a carriage which carries a recording head reciprocates, it is known that an accuracy with which ink droplets ejected from the recording head attach to target or intended positions on a recording medium such as a sheet of paper is largely influenced by not only ejection-related conditions such as an accuracy with which nozzle holes are formed and a water-repellent property of a nozzle surface of the recording head in which the nozzle holes are formed, but also flying conditions under which the ink droplets fly from the recording head to the recording medium. Namely, it is known that the ink droplets ejected from the recording head are subjected, during flying toward the recording medium, to air flows (cross winds) caused as a result of the reciprocating movement of the carriage on which the recording head is mounted.

Where there is a variation in the degree of influence of the air flows among the ink droplets ejected from the respective nozzle holes, actual attaching positions on the recording medium to which the respective ink droplets actually attach deviate from target attaching positions on the recording medium to which the respective ink droplets should attach. In bi-directional printing, this causes bi-directional deviation in the attaching position of the ink droplet, resulting in a deterioration in the printing quality.

Particularly, in the light of the recent trend toward high-speed operation of the carriage as well as downsizing of the ink-jet printer, the moving speed of the carriage is increased to a level ranging from about 75 cm/s to about 100 cm/s. Therefore, the air flows generated by the reciprocating movement of the carriage give a significantly large influence on the flying of the ink droplets from the recording head toward the recording medium.

Described more specifically, the ink-jet printer has a structure shown in FIGS. 3-5, for instance. The ink-jet printer generally indicated at 101 includes a casing 102 consisting of an upper casing member 102A and a lower casing member 102B. The casing 102 defines a closed interior space which is inhibited from communicating with an outside. In the interior space of the casing 102, a head unit 103 is disposed so as to be reciprocally movable, relative to a recording medium P, by driving means (not shown) in a rightward and leftward (transverse) direction of the printer indicated by an arrow A in FIG. 3 along a guide portion 104A supported by a frame 104, so that images, characters, and the like are recorded on the recording medium P. The head unit 103 includes a carriage 103A and a recording head 103B mounted on the carriage 103A. Ink droplets are ejected from a plurality of nozzle holes of the recording head 103B for performing printing on the recording medium P placed on a platen 105. The frame 104 also supports a sheet feed roller 106 and a sheet-discharge roller 107 such that these rollers 106, 107 are rotatable. In the following description, the direction in which the head unit 103, accordingly the carriage 103A moves may be referred to as a "carriage-moving direction".

In the thus constructed ink-jet printer 101, for the purpose of downsizing the printer 101, a clearance S1 (FIG. 3) between a spatial region defined by the movement of the head unit 103 and an upper portion of the casing 102, in other words, between an upper surface of the carriage 103A and the upper portion of the casing 102, is made as small as a clearance S2 (FIG. 3) between a nozzle surface of the recording head 103B in which the nozzle holes are formed and the recording medium P. In this arrangement, the above-described air flows caused as a result of the movement of the carriage 103A and entered the clearance S1 are not likely to pass through the clearance S1.

In the meantime, clearances S3, S4 (FIG. 4) between respective side surfaces of the carriage 103A which are opposed to each other in a perpendicular direction that is perpendicular to the carriage-moving direction in plan view and portions of the casing 102 which are respectively opposed to the respective side surfaces of the carriage 103A are larger than the above-described clearance S1 between the upper surface of the carriage 103A and the upper portion of the casing 102. Therefore, the air flows generated by the movement of the carriage 103A and entered the clearance S1 are likely to flow toward the clearances S3, S4 as shown in FIG. 6A. Accordingly, the ink droplets ejected from the nozzle holes in the neighborhood of the clearances S3, S4 are influenced by the air flows more largely than the ink droplets ejected from the other nozzle holes, causing deviation (disturbance) in the attaching positions of the respective ink droplets ejected from the nozzle holes in the neighborhood of the clearances S3, S4. In other words, the deviation of the attaching positions of the ink droplets ejected from the opposite end portions of the recording head 103B as seen in the perpendicular direction (in the neighborhood of the clearances S3, S4) becomes larger than the deviation of the attaching positions of the ink droplets ejected from a middle portion of the recording head 103B as seen in the perpendicular direction.

Described more specifically, under ink-ejection conditions in which, upon ejection of the ink droplets, small-sized ink particles (hereinafter may be referred to as "satellite particles") are ejected together with main ink particles, there are recorded, on the recording medium, dots U2 formed by attachment of the satellite particles, in addition to dots U1 formed by attachment of the main particles, as shown in FIG. 6B. In this instance, because the satellite particles are lightweight, the satellite particles ejected from the opposite end portions of the recording head (in the neighborhood of the clearances S3, S4) as seen in the perpendicular direction are largely influenced by the air flows flowing from the clearance S1 toward the clearances S3, S4, so that the attaching positions of those satellite particles largely deviate from the target attaching positions. In other words, since air flows flowing on the recording medium in the vicinity of the clearances S3, S4 flow or escape outwards and upwards through the clearances S3, S4, the lightweight satellite particles are influenced by such air flows and undesirably fly in directions inclined with respect to a direction in which the main particles fly. The dots U2 formed by attachment of the satellite particles nearer to the clearances S3, S4 tend to largely deviate in directions inclined with respect to the dots U1 formed by attachment of the corresponding main particles.

Where the casing 102 has the closed structure which inhibits communication with the outside, the above-indicated air flows generated by the reciprocating movement of the carriage 103A hardly escape or leak from the casing 102. Therefore, it is conceivable that the above-indicated tendency becomes larger, namely, the influence of the above-indicated air flows on the flying of the ink droplets becomes larger.

In an attempt to prevent the deterioration in the print quality due to the air flows generated as a result of the reciprocating movement of the head unit (the carriage), it is proposed in U.S. Pat. No. 6,561,620 corresponding to JP-A-2002-361858, for instance, to provide a skirt member which extends from the carriage in the carriage-moving direction so as to be substantially parallel with the nozzle surface of the recording head.

SUMMARY OF THE INVENTION

The provision of such a skirt member, however, results in an increase in the weight of the carriage and raises an obstacle to an increase in the moving speed of the carriage.

Accordingly, it is desired to reduce the influence of the air flows generated as a consequence of the reciprocating movement of the carriage by increasing or extending the nozzle surface in the carriage-moving direction while minimizing the weight of the carriage, for thereby making deviation of the attaching positions of the ink droplets uniform among the respective ink droplets or eliminating the deviation. If the deviation of the attaching positions is made uniform among the respective ink droplets, it is conceivable that formation of undesirable interference patterns due to mutually different deviation amounts of the attaching positions of the respective ink droplets can be avoidable, even if ordinary interlace printing is performed.

The inventor of the present invention made an extensive study on the above-indicated air flows arising from the reciprocating movement of the carriage while considering a reduction in the weight of the carriage. As a result of the sturdy, the inventor has noticed the following: It is estimated that the air flows flowing on the recording medium flow outwards through the above-indicated clearances S3, S4, causing the deviation in the attaching positions of the ink droplets on the recording medium. Accordingly, the inventor conceived an idea of restraining the influence of the air flows flowing outwards through the clearances S3, S4 by forming a skirt member to have a shape in plan view in which portions of the skirt member in the vicinity of the clearances S3, S4 largely protrude in the carriage-moving direction. In view of this, the present invention has been developed in which an improvement in the attaching accuracy of the ink droplets on the recording medium is assured while reducing the weight of the carriage to meet the demand for an increase in its moving speed. It is therefore an object of the invention to provide an ink-jet printer which is capable of preventing the air flows flowing on the recording medium from influencing on the flying of the ink droplets owing to a provision of a lightweight skirt member.

The above-indicated object of the invention may be achieved according to a principle of the invention, which provides an ink-jet printer, comprising: a casing; a head unit which is disposed in the casing and which includes (a) a carriage that moves reciprocally relative to a recording medium and (b) a recording head mounted on the carriage for ejecting ink droplets from a plurality of nozzle holes; and a pair of skirt members which are provided respectively on opposite sides of the carriage as seen in a carriage-moving direction in which the carriage moves, so as to protrude outwardly from respective first side surfaces of the carriage that are opposed to each other in the carriage-moving direction and which are flush with a nozzle surface of the recording head in which the plurality of nozzles are open, for rectifying air flows which are generated as a result of the movement of the carriage and which flow on the recording medium, each of the pair of skirt members protruding, in the carriage-moving direction, at opposite end portions thereof as seen in a perpendicular direction that is perpendicular to the carriage-moving direction in plan view, by an amount larger than at a middle portion thereof as seen in the perpendicular direction.

In the ink-jet printer constructed as described above, the pair of skirt members provided respectively on the opposite sides of the carriage as seen in the carriage-moving direction so as to protrude outwardly from the respective first side surfaces of the carriage exhibit an effective air-flow rectifying function so as to effectively rectify or control the air flows which are generated as a result of the reciprocating movement of the carriage and which flow on the recording medium.

Here, there are clearances between respective second side surfaces of the carriage which are opposed to each other in the perpendicular direction that is perpendicular to the carriage-moving direction and portions of the casing which respectively face the respective second side surfaces of the carriage, i.e., clearances between respective front and back parts of the head unit that are opposed to each other in the perpendicular direction and respective front and back parts of the casing which are opposed to each other in the perpendicular direction and between which the head unit is interposed. Therefore, the air flows flowing on the recording medium (on an underside of the nozzle surface) tend to flow outwards through those clearances. In this respect, each of the pair of skirt members protrudes, in the carriage-moving direction, at opposite end portions thereof in the perpendicular direction that is perpendicular to the carriage-moving direction in plan view, by an amount larger than at a middle portion thereof as seen in the perpendicular direction. Therefore, the air-flow rectifying effect provided by the pair of skirt members can be enhanced, whereby the air flows are prevented from flowing outwards at the opposite end portions of the recording head. Consequently, the attaching positions of the ink droplets are less likely to be deviated, resulting in an improvement in the printing accuracy.

Described more specifically, the air-flow rectifying effect is enhanced owing to the configuration of the skirt member in which the opposite end portions thereof as seen in the perpendicular direction protrude in the carriage-moving direction by a larger amount than the middle portion thereof as seen in the perpendicular direction, so that the air flows are prevented from being disturbed due to the existence of the clearances explained above. On the other hand, the air flows flowing on the recording medium at the middle portion of the recording head are allowed to flow without being influenced by the existence of the clearances. Therefore, the air flows flowing on the recording medium at the middle portion of the recording head need not be rectified by the skirt member. Thus, in the present arrangement, the air-flow rectifying function of the skirt member is tuned in the perpendicular direction depending upon the degree of necessity of rectifying the air flows.

BRIEF DESCRIPTION OF THE DRAWINGS

The above and other objects, features, advantages and technical and industrial significance of the present invention will be better understood by reading a following detailed description of a preferred embodiment of the invention, when considered in connection with the accompanying drawings, in which:

FIGS. 1A-1C are views showing a head unit according to the invention, wherein FIG. 1A is a plan view, FIG. 1B is a front view, and FIG. 1C is a view for explaining an air-flow rectifying effect by skirt members;

FIGS. 6A-6B are views showing a conventional head unit, wherein FIG. 6A is a view for showing air flows and FIG. 6B is a view for explaining an attached state of ink droplets on a recording medium according to the conventional head unit.

DETAILED DESCRIPTION OF THE PREFERRED EMBODIMENT

Figure 1A:
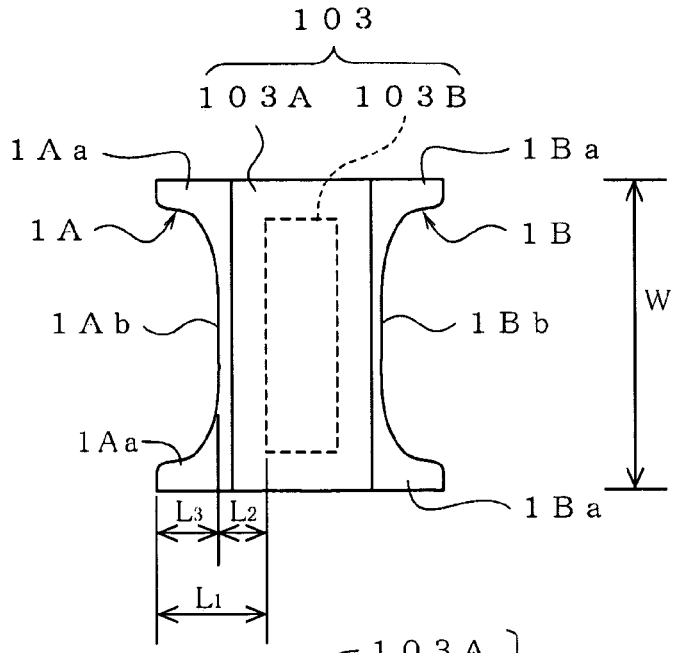
Figure 1B:
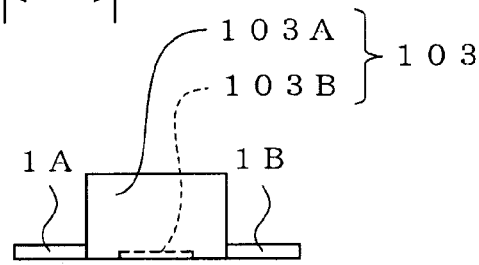

Referring to the drawings, there will be described a preferred embodiment of the present invention. Because an ink-jet printer according to the present invention is identical in construction with the ink-jet printer shown in FIGS. 3-5, except for a structure of skirt members 1A, 1B (which will be explained), the same reference numerals are used to identify the corresponding components and a detailed explanation of which is dispensed with.

Figure 1C:
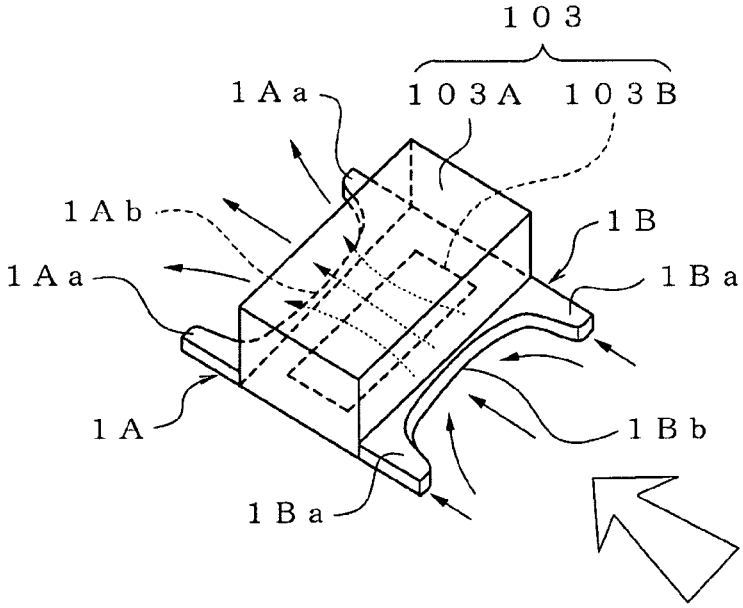
Figure 2:
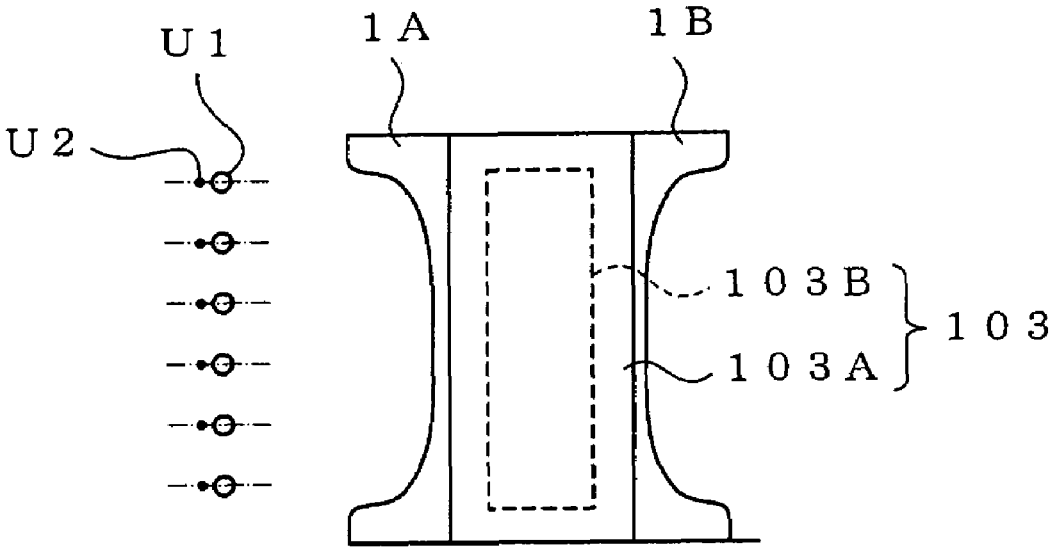
FIG. 2 is a view for explaining an attached state of ink droplets on a recording medium according to the head unit of the invention.
Figure 3:
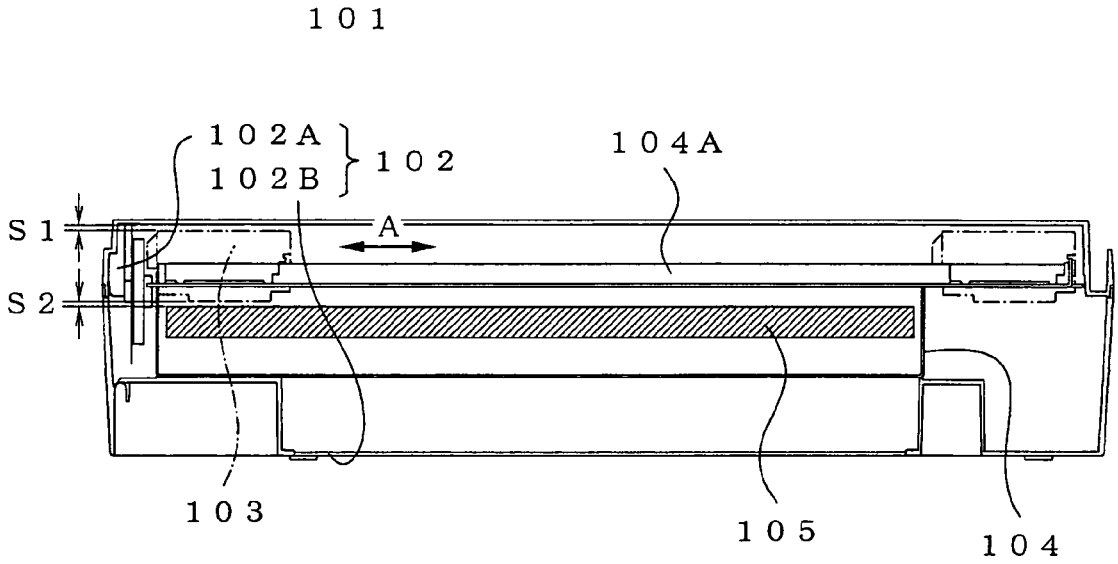
FIG. 3 is a front elevational view in cross section showing an ink-jet printer based on which an ink-jet printer of the invention has been developed.
Figure 4:
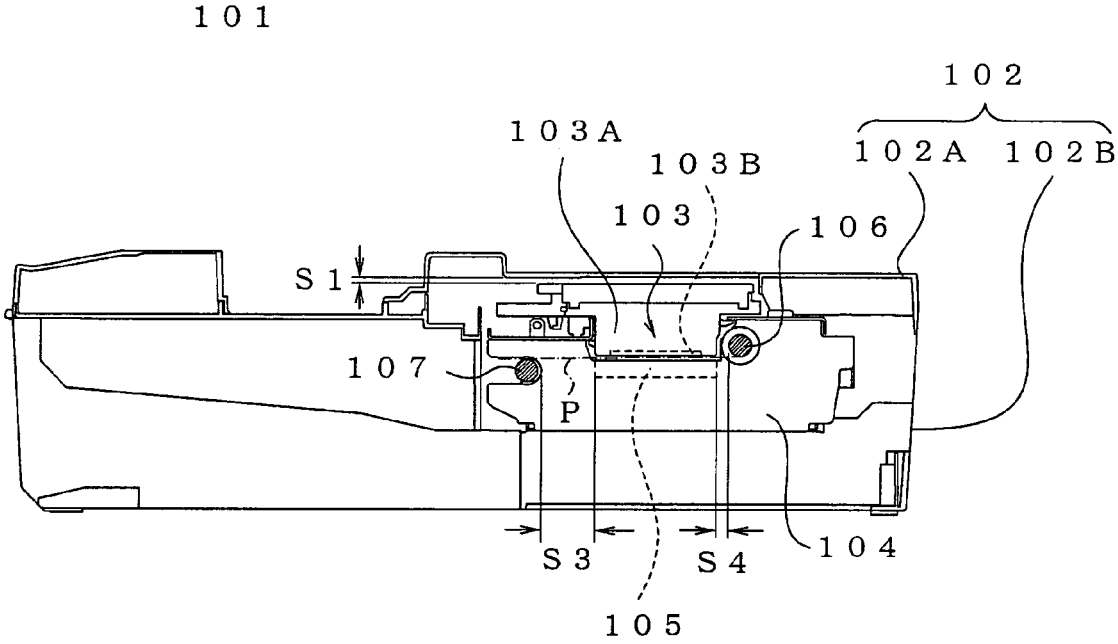
FIG. 4 is a side elevational view in cross section showing the ink-jet printer of FIG. 3.
Figure 5:
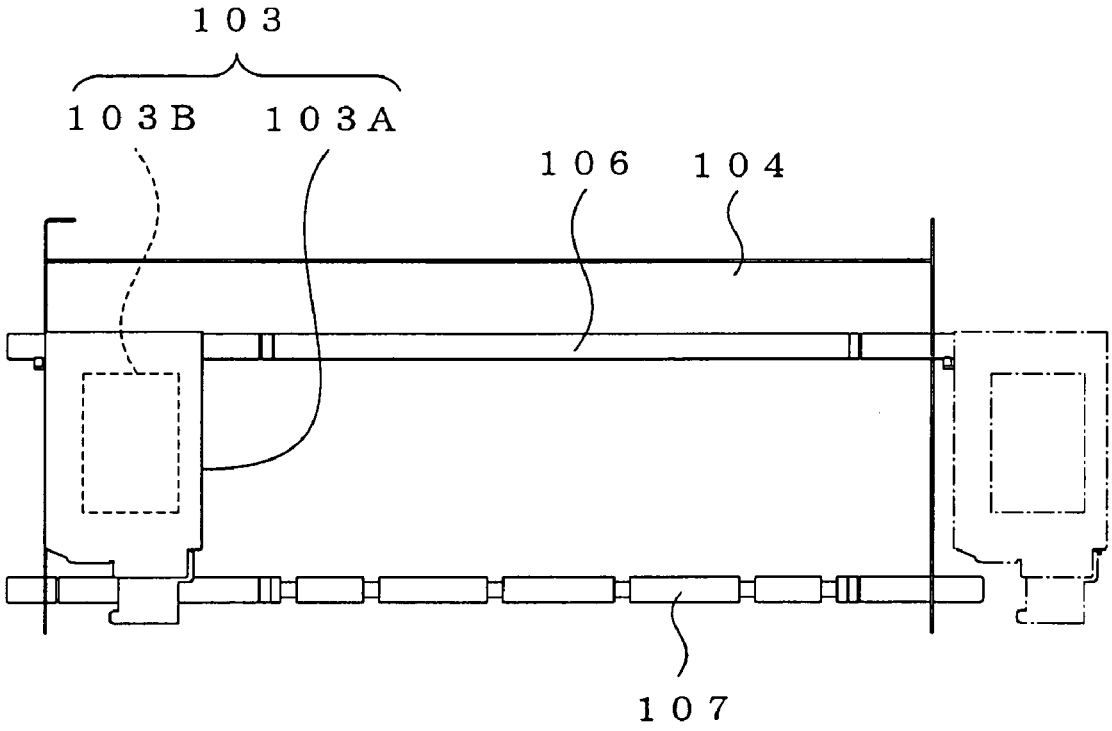
FIG. 5 is a plan view showing an internal structure of the ink-jet printer of FIG. 3.
Figure 6A:
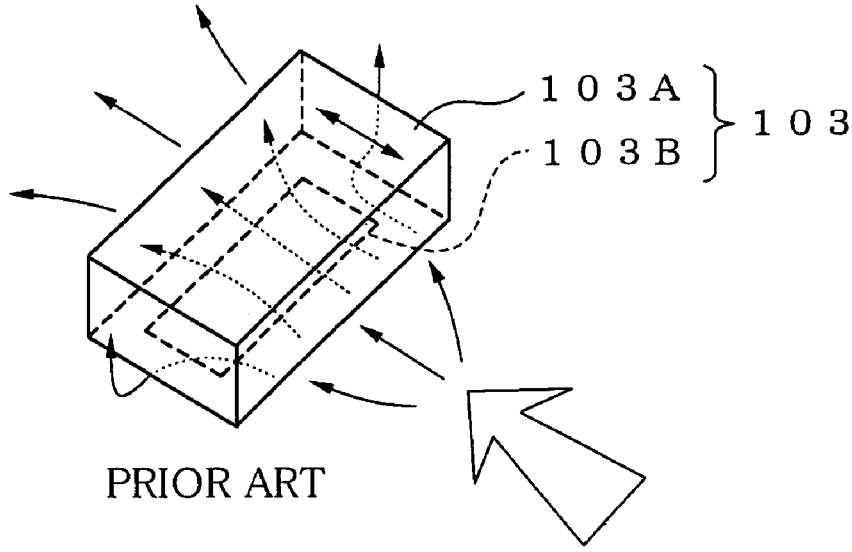
Figure 6B:
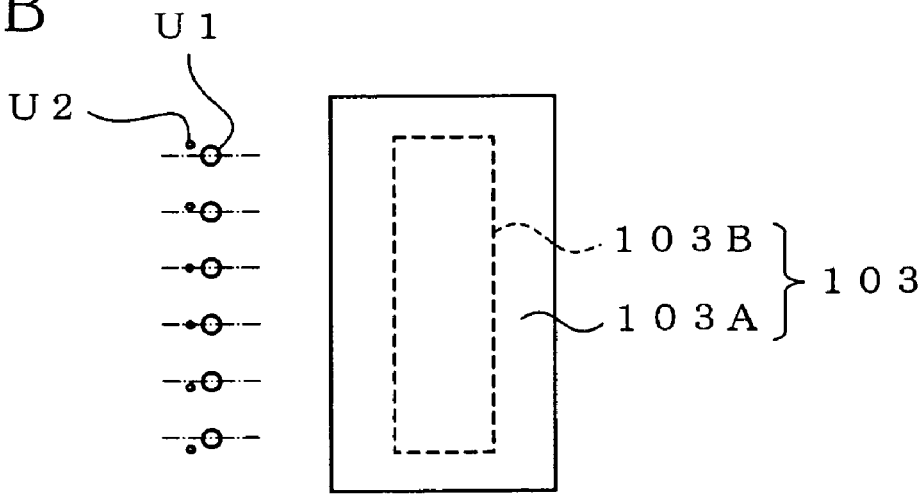
PRIOR ART FIG.6B

As described above in the BACKGROUND OF THE INVENTION with respect to FIGS. 3-5, an ink-jet printer 101 includes a casing 102 in which is disposed a head unit 103 including a carriage 103A and a recording head 103B mounted on the carriage 103A. The head unit 103, namely, the carriage 103A reciprocally moves in the casing 102, and the recording head 103B ejects droplets of ink from a plurality of nozzle holes so that images, characters, etc., are printed on a recording medium P. In the present embodiment, there are provided skirt members 1A, 1B (as shown in FIGS. 1A-1C and FIG. 2) each as an air-flow rectifying or adjusting member which rectifies or adjusts air flows flowing on the recording medium P and which is formed so as to be co-planar with a nozzle surface of the printing head 103B outwardly of the carriage 103A. As described below, the skirt members 1A, 1B according to the present invention differ in configuration from a carriage skirt disclosed in the above-indicated U.S. Pat. No. 6,561,620.

The carriage 103A is a rectangular shape in plan view. On opposite sides of the carriage 103A as seen in a direction in which the carriage 103A reciprocally moves (i.e., in a carriage-moving direction), the skirt members 1A, 1B are respectively provided so as to protrude outwardly from respective first side surfaces of the carriage 103A that are opposed to each other in the carriage-moving direction. Each skirt member 1A, 1B extends over an entire length of the carriage 103A as seen in a perpendicular direction that is perpendicular to the carriage-moving direction in plan view. In each skirt member 1A, 1B, its opposite end portions 1Aa, 1Bb protrude in the carriage-moving direction by an amount larger than its middle portion 1Ab, 1Bb. Each skirt member 1A, 1B is flush, at its lower surface, with the nozzle surface as if the skirt member 1A, 1B extends from the nozzle surface, and is disposed so as to be parallel with the recording medium to which each skirt member 1A, 1B is opposed.

Described more specifically, in each of the skirt members 1A, 1B, the amount of protrusion in the carriage-moving direction gradually and smoothly decreases from its opposite end portions 1Aa, 1Ba toward its middle portion 1Ab, 1Bb, such that each skirt member 1A, 1B has a curved profile and such that its middle portion 1Ab, 1Bb is substantially flush with a corresponding one of the first side surfaces of the carriage 103A, i.e., such that the middle portion 1Ab, 1Bb hardly protrudes. The thus constructed skirt members 1A, 1B in which the amount of protrusion in the carriage-moving direction gradually, continuously, and smoothly decreases advantageously has a reduced weight without deteriorating its air-flow rectifying function (that will be explained below in detail).

It is noted that the curved profile of each skirt member 1A, 1B and the maximum amount of protrusion are suitably determined depending upon a result of measurement in which deviation of dots formed by attachment of ink droplets on the recording medium is obtained in actual printing. For instance, a distance L1 (FIG. 1A), as measured in the carriage-moving direction, between each end of the recording head 103B as seen in the perpendicular direction and a corresponding one of the opposite end portions of each skirt member 1A, 1B may be made larger than 1.5 times a distance L2 (FIG. 1A), as measured in the carriage-moving direction, between the each end of the recording head 103B and a portion of each skirt member 1A, 1B at which the amount of protrusion is the smallest. Preferably, the distance L1 may be made larger than twice the distance L2. Further, for instance, a distance L3 (FIG. 1A), as measured in the carriage-moving direction, between each of the opposite end portions of each skirt member 1A, 1B and the portion of each skirt member 1A, 1B at which the amount of protrusion is the smallest made be larger than 10% of a dimension or length W (FIG. 1A) of each skirt member 1A, 1B as measured in the perpendicular direction. Preferably, the distance L3 may be made larger than 15% of the dimension W.

In each of the skirt members 1A, 1B, a point at which the amount of protrusion is the smallest, as seen in the perpendicular direction, and a center point of a nozzle region in which the plurality of nozzle holes are distributed, as seen in the perpendicular direction, are situated at the same position in the carriage-moving direction. In this arrangement, the configuration of each skirt member 1A, 1B is determined so as to be in accord with the distribution of the nozzle holes in the nozzle region, so that the influence of the air flows generated by the movement of the carriage 103A on the ink droplets ejected from the nozzle holes can be effectively reduced. In this embodiment, the point of each skirt member 1A, 1B at which the amount of protrusion is the smallest is located at a midpoint of the opposite end portions 1Aa, 1Bb thereof. The dimension (length) W of each skirt member 1A, 1B as measured in the perpendicular direction may be determined depending upon the distribution of the nozzle holes in the nozzle region. In the present embodiment wherein a length of the recording head 103B as measured in the perpendicular direction is smaller than the length of the carriage 103A as measured in the perpendicular direction, the dimension W of the skirt member 1A, 1B is made substantially equal to the length of the carriage 103A. In any case, the dimension W of the skirt member 1A, 1B should be determined to be larger than a dimension of the nozzle region as measured in the perpendicular direction.

On the opposite end portions of the recording head 103B which are opposed to each other in the perpendicular direction, the air flows flowing over the recording medium tend to flow outwards and upwards through the aforementioned clearances S3, S4, whereby the attaching positions of the ink droplets on the recording medium tend to deviate from the target attaching positions. In the present embodiment, however, the opposite end portions 1Aa, 1Bb of each skirt member 1A, 1B corresponding to the opposite end portions of the recording head 103B protrude largely in the carriage-moving direction, so that the air flows which tend to flow outwards can be rectified by the opposite end portions 1Aa, 1Bb of each skirt member 1A, 1B, as shown in FIG. 1C. In other words, a component of the air flows which tends to flow outwards can be reduced owing to the skirt members 1A, 1*b* constructed as described above. Consequently, the amount and direction of the air flows flowing between the nozzle surface and the recording medium are made comparatively uniform, irrespective of the locations of the nozzle holes, thereby reducing the deviation of the actual attaching positions of the ink droplets from the target attaching positions.

Accordingly, even if the moving speed of the carriage 103A (the head unit 103) in the casing 102 becomes high, the deviation of the attaching positions of the ink droplets can be reduced. Thus, the accuracy with which the ink droplets attach to the target positions on the recording medium can be improved while decreasing the weight of the head unit 103 (the carriage 103A).

In the present embodiment, the amount of protrusion of each skirt member 1A, 1B in the carriage-moving direction is decreased to an extent that the skirt member 1A, 1B is substantially flush, at its middle portion 1Ab, 1Bb, with the corresponding first side surface of the carriage 103A. In other words, each skirt member 1A, 1B hardly protrudes in the carriage-moving direction at its middle portion 1Ab, 1Bb. Accordingly, this arrangement is effective to reduce the weight of the carriage 103A as compared with a case in which each skirt member protrudes throughout its length as measured in the perpendicular direction that is perpendicular to the carriage-moving direction.

Accordingly, this arrangement improves the accuracy with which the ink droplets are attached to the target positions on the recording medium while reducing the weight of the head unit 103.

In improving the attaching accuracy of the ink droplets, it is effective to minimize a clearance between the nozzle holes (the nozzle surface) and the recording medium. At the same time, the air existing ahead of the carriage when the carriage moves in its moving direction need to be escaped. If such air is not effectively escaped, there may be caused strong, complex air flows on the underside of the nozzle surface, so that the attaching positions of the ink droplets are undesirably deviated as a whole.

It is particularly important to effectively escape the air in a case where the downsizing (i.e., the reduction in height) is attained as in the ink-jet printer 101 of FIGS. 3-5. In detail, in the ink-jet printer 101 wherein the casing 102 defines the closed interior space which is inhibited from communicating with the outside, where the clearance S1 between the upper surface of the carriage 103A and the upper portion of the casing 102 is made substantially as small as the clearance S2 (1-3 mm) between the nozzle surface of the recording head 103B and the recording medium, it is important to effectively escape the air described above. More specifically described, in the ink-jet printer 101, the clearances S3, S4 between the respective second side surfaces of the carriage 103A that are opposed to each other in the perpendicular direction and the portions of the casing 102 which respectively face the respective second side surfaces of the carriage 103A are both made larger than the above-indicated clearance S1, that is, the clearance S3 is equal to about 20 mm and the clearance S4 is equal to about 5 mm. Where there is a large difference between the clearance S1 and the clearances S3, S4, the attaching positions of the ink droplets are less likely to be influenced by the air flows generated as a result of the reciprocating movement of the carriage 103A. On the other hand, where the difference between the clearances S1 and the clearances S2, S3 is not sufficiently large, the air flows flowing on the recording medium tend to flow outwards through the clearances S3, S4.

Where the casing 102 is configured to define the closed interior space and the clearance S1 between the upper surface of the carriage 103A and the upper portion of the casing 102 is made substantially equal to the clearance S2 between the nozzle surface of the recording head 103B and the recording medium as described above, a spatial region within the casing 102 is comparatively small, so that it may be considered that the influence of the air flows on the ink droplets ejected from the nozzle holes is large. In the present embodiment, however, the skirt members 1A, 1B configured as described above exhibit the air-flow rectifying function so as to effectively reduce the influence of the air flows on the ink droplets. Because the influence of the air flows on the ink droplets increases with an increase in the moving speed of the carriage 103A, this arrangement is advantageous particularly where the carriage 103A is moved at a high speed. Further, where the clearances S3, S4 between the respective second side surfaces of the carriage 103A that are opposed to each other in the perpendicular direction and the portions of the casing 102 which respectively face the respective second side surfaces of the carriage 103A are both made larger than the above-indicated clearance S1 as described above, it may be considered that the air flows are likely to flow through the clearances S3, S4. In the present embodiment, however, the air flows are prevented from flowing through the clearances S3, S4 owing to the air-flow rectifying function of the skirt members 1A, 1B.

Thus, the skirt members 1A, 1B constructed according to the present embodiment is effective for rectifying the air flows. In the ink-jet printer 101 having the thus constructed skirt members 1A, 1B, therefore, the dots U1 formed on the recording medium by attachment of the main particles and the dots U2 formed on the recording medium by attachment of the satellite particles hardly deviate from the respective target positions, as shown in FIG. 2. Accordingly, the skirt members 1A, 1B assure improved accuracy with which the ink droplets attach to the target positions on the recording medium while reducing the weight of the head unit 103 (the carriage 103A).

In the illustrated embodiment, the casing 102 is configured to define the closed interior space that is inhibited from communicating with the outside. The casing 102 may be configured otherwise. Even in an instance wherein the casing does not have such a closed structure, if the above-indicated clearances S1-S4 are formed in the casing around the head unit as a consequence of the reduction in the size (the height) of the casing, the same advantages mentioned with respect to the illustrated embodiment are assured by employing the present skirt members.

It is to be understood that the invention is not limited to the details of the illustrated embodiment, but may be embodied with various changes and modifications, which may occur to those skilled in the art, without departing from the spirit and scope of the invention defined in the attached claims.

What is claimed is:

1. An ink-jet printer, comprising:

a casing;

a head unit which is disposed in the casing and which includes (a) a carriage that moves reciprocally relative to a recording medium and (b) a recording head mounted on the carriage for ejecting ink droplets from a plurality of nozzle holes; and a pair of skirt members which are provided respectively on opposite sides of the carriage as seen in a carriage-moving direction in which the carriage moves, so as to protrude outwardly from respective first side surfaces of the carriage that are opposed to each other in the carriage-moving direction and which are flush with a nozzle surface of the recording head in which the plurality of nozzles are open, for rectifying air flows which are generated as a result of the movement of the carriage and which flow on the recording medium, each of the pair of skirt members protruding, in the carriage-moving direction, at opposite end portions thereof as seen in a perpendicular direction that is perpendicular to the carriage-moving direction in plan view, by an amount larger than at a middle portion thereof as seen in the perpendicular direction, such that the air flows are prevented from flowing outwards in the perpendicular direction at the opposite end portions while the air flows are maintained at the middle portion.

2. The ink-jet printer according to claim 1, wherein said each of the pair of skirt members is configured such that the amount of protrusion from a corresponding one of the first side surfaces of the carriage gradually decreases from the opposite end portions thereof toward the middle portion thereof.

3. The ink-jet printer according to claim 1, wherein said each of the pair of skirt members hardly protrudes, in the vicinity of the middle portion thereof, from a corresponding one of the first side surfaces of the carriage.

4. The ink-jet printer according to claim 1, wherein a point of said each of the pair of skirt members at which the amount of protrusion is the smallest, as seen in the perpendicular direction, and a center point of a nozzle region in which the plurality of nozzle holes are distributed, as seen in the perpendicular direction, are situated at the same position in the carriage-moving direction.

5. The ink-jet printer according to claim 4, wherein the point of said each of the pair of skirt members at which the amount of protrusion is the smallest is located at a midpoint of the opposite end portions.

6. The ink-jet printer according to claim 1, wherein the casing defines a closed interior space in which the head unit is disposed, for inhibiting communication with an outside, and wherein a first clearance between an upper surface of the carriage and an upper portion of the casing is substantially equal to a second clearance between a nozzle surface of the recording head in which the plurality of nozzle holes are open and the recording medium.

7. The ink-jet printer according to claim 6, wherein third and fourth clearances between respective second side surfaces of the carriage which are opposed to each other in the perpendicular direction and portions of the casing which respectively face the respective second side surfaces of the carriage are larger than the first clearance between the upper surface of the carriage and the upper portion of the casing.

8. The ink-jet printer according to claim 1, wherein the pair of skirt members do not protrude in the perpendicular direction.

9. The ink-jet printer according to claim 1, wherein a first distance, as measured in the carriage-moving direction, between each end of the recording head as seen in the perpendicular direction and a corresponding one of the opposite end portions of said each of the pair of skirt members is larger than 1.5 times a second distance, as measured in the carriage-moving direction, between said each end of the recording head and a portion of said each of the pair of skirt members at which the amount of protrusion is the smallest.

10. The ink-jet printer according to claim 1, wherein a distance, as measured in the carriage-moving direction, between each of the opposite end portions of said each of the pair of skirt members and a portion of said each of the pair of skirt members at which the amount of protrusion is the smallest is larger than 10% of a dimension of said each of the pair of skirt members as measured in the perpendicular direction.

* * * * *